United States Patent [19]

Lafosse

[11] Patent Number: 4,494,781

[45] Date of Patent: Jan. 22, 1985

[54] SELF-LOCKING LOCK ASSEMBLY

[75] Inventor: Jean Lafosse, Mareil Marly, France

[73] Assignee: La Telemecanique Electrique, France

[21] Appl. No.: 427,025

[22] Filed: Sep. 29, 1982

[30] Foreign Application Priority Data

Oct. 6, 1981 [FR] France ..... 81 19125

[51] Int. Cl.[3] ..... E05C 5/02; E05B 65/44

[52] U.S. Cl. ..... 292/60; 70/79; 70/81; 70/139; 70/145

[58] Field of Search ..... 70/79, 81, 135, 138, 70/139, 144, 145, DIG. 79; 292/57, 60, 63, 201, 292/219, 228, 280

[56] References Cited

U.S. PATENT DOCUMENTS 368,684 8/1887 Phillips ..... 70/DIG. 79

2,680,640 6/1954 Carry ..... 292/22 B

*Primary Examiner*—Robert L. Wolfe

*Attorney, Agent, or Firm*—William A. Drucker

[57] ABSTRACT

A self-locking lock assembly for a cabinet or locker door includes a rotary operating member (25) having a head (26) adapted to be operated from the exterior of the door, and an inner bolt (31) provided with a rib (36) inclined with respect to the axis of said operating member so that its cooperation with a flange (14) of a door opening (3) causes it to rotate while compressing a return spring (41) whenever the door is manually pushed. The lock assembly can advantageously be used in cabinets or lockers the doors of which must be opened only by safety personnel, but may be closed by maintenance personnel.

5 Claims, 14 Drawing Figures

FIG. 1
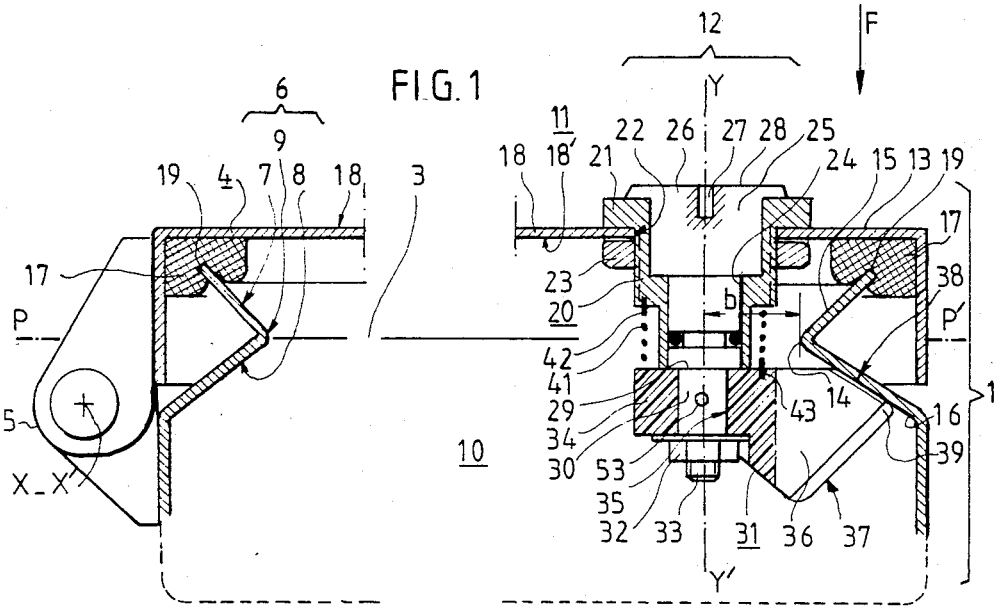
FIG. 2
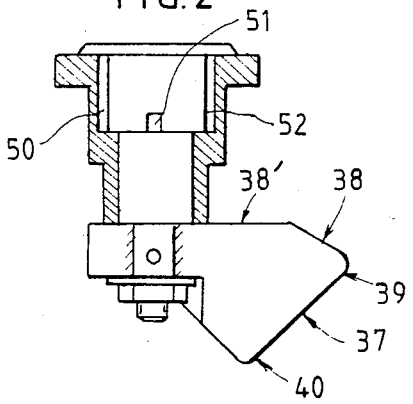
FIG. 3
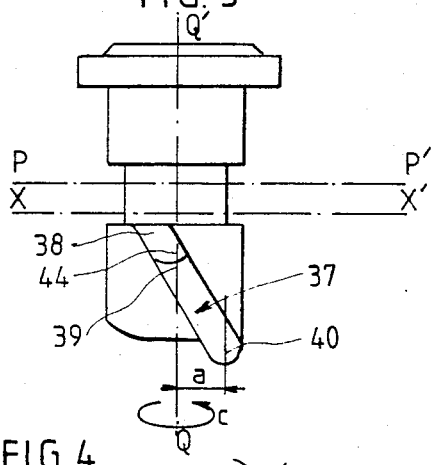
FIG. 5
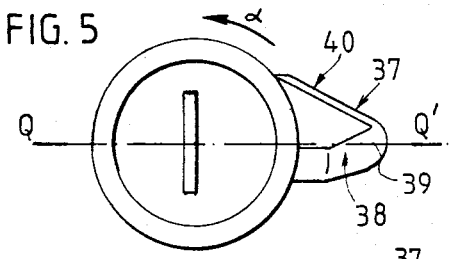
FIG. 4
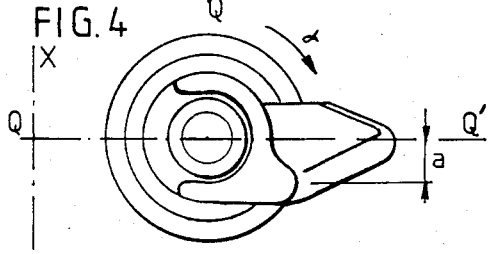
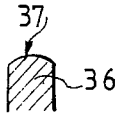
FIG. 6

FIG. 5 bis

SELF-LOCKING LOCK ASSEMBLY

BACKGROUND OF THE INVENTION

The invention relates to a lock assembly adapted to be disposed on a locker or cabinet door adjacent to a flange surrounding an opening in said cabinet, comprising, on the one hand, a rotary operating member accessible from the exterior of the door and rotatably mounted in a body integral with said door about an axis orthogonal to the plane thereof and, on the other hand, an inner movable bolt which is associated to said operating member and to a return or compression spring which biases it towards an inoperative position, said bolt being provided with an inclined ramp adapted to cooperate with said flange so that said bolt first is moved backwards while compressing said spring whenever a force is applied to said door in a direction tending to close it, and then is moved in the opposite direction and is thus engaged under said flange, whereby the lock can be opened only by inserting either a key or a tool into said operating member.

THE PRIOR ART

Locks of the above type may be disposed on locker on cabinet doors particularly for housing electrical equipment; in the latter case, such locks have the advantage to enable the maintenance personnel to close the cabinet without the safety personnel members, who only have means such as special keys usually used to open the cabinet, need to be present at that time.

OBJECT OF THE INVENTION

The object of the invention is to provide a lock assembly both having the above construction and allowing the above use which will be simpler than heretofore known locks and which will be strong enough so as to withstand shocks experienced thereby whenever the cabinet door will be slammed closed.

SUMMARY OF THE INVENTION

In accordance with the invention such an object is achieved due to the fact that the above-mentioned bolt includes a flange angularly associated to an inner end of the operating member and is provided with a first ramp inclined with respect to axis YY' of said operating member and not extending through this axis, said ramp having a first contact point spaced by a first distance from axis YY' and first engaging with said flange upon closure of the door and an end spaced by a second distance from said axis, the second distance being greater than the first one, said end subsequently engaging itself under a wall of the frame which extends from said flange towards the interior space of the cabinet.

BRIEF DESCRIPTION OF THE DRAWINGS

The above-mentioned features and further features and means provided for improving operation of said lock and make it highly simplified will be better understood from the disclosure hereinbelow. In the accompanying drawings:

FIG. 1 is a longitudinal cross-sectional view along QQ' of a cabinet or locker provided with a lock assembly which can be opened with a tool and closed without said tool;

FIG. 2 is a longitudinal cross-sectional view of the lock assembly alone;

FIG. 3 is an outer right-hand side view of the lock assembly according to FIGS. 1 and 2;

FIG. 4 shows an outer bottom view of the lock assembly;

FIG. 5 shows an outer top view of the lock assembly;

FIG. 5 bis shows a cross-sectional view of the lock actuating means;

FIG. 6 shows a particular part of the bolt;

DESCRIPTION OF THE PREFERRED EMBODIMENT

Figure 7:
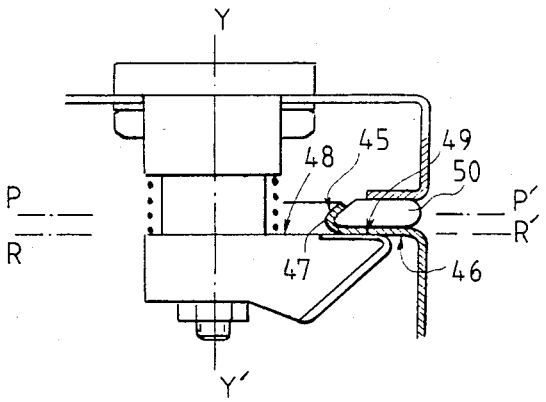
FIG. 7 illustrates a second embodiment of the lock.

A cabinet or locker 1 as shown in FIG. 1 as a non-restrictive example of use of the invention essentially comprises a casing 2 provided with an opening 3, a door 4 and a hinge 5 pivotable about an axis XX' which is substantially parallel to plane PP' of the opening. Frame 6 of the opening has, in a known per se manner, a first planar portion 7 inclined with respect to plane PP' and extending towards the outer space 11 of the cabinet, a second planar portion 8 also inclined with respect to plane PP' and extending towards the cabinet inner space 10, and a flange or edge 9 where said planar portions join each other in the form of a somewhat rounded intersection and which lies in plane PP'.

A lock assembly 12 which is disposed in an area 13 of the door opposite to hinge 5 cooperates with flange 14 opposite to flange 9 and with first and second portions 15, 16 which are similar and oppositely arranged with respect to portions 7, 8 respectively.

A resiliently compressible seal 17 is disposed between rear surface 18' of wall 18 of door 4 and edges such as 19 which bound outwardly first portion 15, 7 of the frame. Flange 14 in fact consists of a small cylindrical surface resulting from bending of the metal plate of which the casing is made, which is disposed substantially in plane PP' and the generating lines of which extend parallel thereto.

Lock assembly 12 comprises a body 20 having an outer flange 21, which extends through an opening 22 in wall 18 and is secured thereto, e.g. by means of a threaded nut 23 which is located within the door. The body is provided with a housing 24 shaped as straight cylinder, acting as a bearing, the axis YY' of which extends substantially orthogonal to the plane of wall 18 and which is open both in the interior and exterior directions.

A cylindrical sleeve 25 serving as an operating member is accomodated in said housing and is provided, at its outer end, with a head 26 having operating means 27 through which it can be rotated, and with a portion 30 disposed outside the housing at its inner end 29; means 27 may be, e.g. a transversely extending groove adapted to accomodate the end of a screw driver (not shown) or a coin.

Said portion 30 accomodates a bolt 31 which is angularly associated thereto, and which is axially secured thereto, e.g. by a nut 32 cooperating with a threaded extension 33 of portion 30. Bolt 31 comprises essentially a flange 34 in which there are provided an opening 35 cooperating with portion 30, and a side rib 36. Said rib has a first ramp 37 inclined with respect to axis YY' and extending towards the cabinet interior, a second ramp 38 which is inclined in the exterior direction and a crest 39 common to both ramps.

As clearly shown in FIGS 2 and 3, first ramp 37 has an engagement or contact point 40 at the remote end of the ramp with respect of wall 18, and an end which merges into crest 39 and is nearer to wall 18 than contact point 40. Second ramp 38 is located between crest 39 and wall 18 and extends to a transverse surface 38' of the flange facing towards the wall.

An angular return spring 41, preferably helically shaped, extending coaxially to axis YY' outside body 20 and acting as a torsion spring, imparts to bolt 31 a return torque which tends to bring it into a closure inoperative position as hereinafter defined and as shown in FIGS. 1, 2 and 5, due to the fact that its opposite ends 42 and 43 are hooked to the body and the bolt, respectively.

Figure 10:
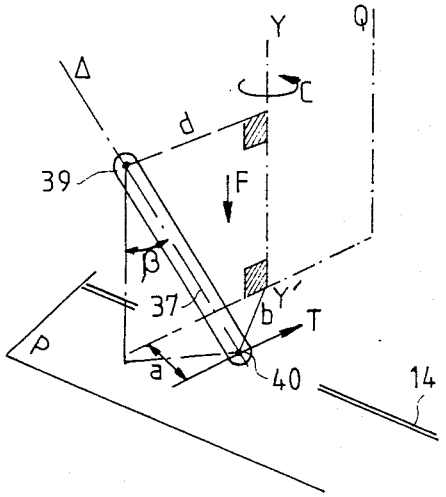
FIG. 10 schematically illustrates the position of a bolt ramp with respect to rotation axis YY'.

The space position of the first ramp with respect to axis YY' is clearly shown in FIG. 10 showing that distance "b" between contact point 40 and axis YY' is shorter than distance "d" between crest 39 and axis YY', and that a straight line connecting points 39 and 40 is angularly disposed with respect to axis YY', thus, straight line Δ does not pass through axis YY'.

Between points 39 and 40 the ramp may either extend along substantially straight-forward direction or form a portion of a conical helix.

On the other hand, as also shown in FIGS. 3 and 5, at least a portion of surface 44 of second ramp 38 located adjacent to crest 39 is on the contrary disposed substantially in a plane QQ' extending through crest 39 and axis YY'.

Between contact point 40 and crest 39, ramp 37 may otherwise be of rounded shape, as shown in localized cross-sectional view along a plane RR' in FIG. 6, so as to help its sliding against flange 14.

The friction occurring between flange 14 and ramp 37 can even be substantially reduced by making the bolt from a suitable plastic material.

When the door is open, bolt 31 is oriented in an inoperative position similar to the one shown in FIG. 1. A closure movement directed along arrow F and imparted by a force applied to the wall firstly brings contact point 40 against flange 14; due to a distance "a" between point 40 and plane QQ' extending through axis YY' in an orthogonal direction to axis XX' (see FIGS. 3 and 4) and due to existence of a tangential component T of the frictional force between point 40 and flange 14 (see FIG. 10), a rotational torque C is applied to bolt 31 which thus pivots about axis YY', such a rotation in the $\alpha$ direction resulting in loading spring 41, bringing successive points of ramp 37 against flange 14 and allowing the closure movement of the door to continue until crest 39 passes beyond the flange. Once the bolt crest has passed beyond the flange, the bolt can move in a direction opposite to $\alpha$ under the action of the return spring, and the lock assembly comes back into the inoperative position as illustrated in FIG. 1, wherein second ramp 38 bears against second portion 16 of the frame. Such a bearing realtionship which is maintained through compression of seal 7 cannot cause any angular movement of the bolt with respect to body 20 due to the fact that surface 44 of ramp 38 now substantially lies in plane QQ'.

The same operation as the just described one can be achieved in a modified embodiment using a different form of frame, as shown in FIG. 7, where it can be seen that first frame portion 45 is of a small width and second frame portion 46 extending in alignment with rounded flange 47 inwardly of the cabinet lies in a plane RR' parallel and rear to PP'; in this case, the bolt form is slightly different and second ramp 38 of the above bolt herein comprises a surface 48 which can be either planar in a direction orthogonal to axis YY' or rounded with generatrixes orthogonal to axis YY'. Such a modification can be used with a seal 50 disposed on the outer surface of second portion 46. The inoperative position of the bolt in which crest 39 substantially lies in plane QQ', as shown in FIG. 3, can be defined by mutual relationship of a bearing surface 50 located in the bore of body 20 and a stop 51 integral with sleeve 25 (see FIG. 2).

A second bearing surface 52 can also be used to limit the movement of the bolt in the opposite direction. Whenever the just described lock assembly is used with a sleeve 25 which is actuated through groove 27, the bolt is angularly associated thereto, e.g. through a pin 53 extending through flange 34 and end 30, or alternatively by giving to end 30 a prismatic shape matching with the shape of opening 35 in flange 34.

Thus, the bolt movements will be dependent upon the sleeve movements, either if the sleeve is actuated from the exterior for the door to be opened, or inversely if the bolt drives the sleeve when the door is closed by means of a pressure applied to the cover wall.

Groove 27 as shown in FIGS. 1 and 5 may be replaced by a housing of triangular, square or hexagonal cross-sectional shape cooperating with the projecting portion of a tool of a matching shape, or alternatively and more advantageously, by a lug of triangular, square or hexagonal cross-sectional shape projecting from the bottom of a blind hole as shown in FIG. 5 bis. As height g of the lug is less than depth h of the blind hole having a diameter h, height g will advantageously be such that $g \leqq 2h/3$ so as to prevent any actuation by another tool than the key.

Figure 8:
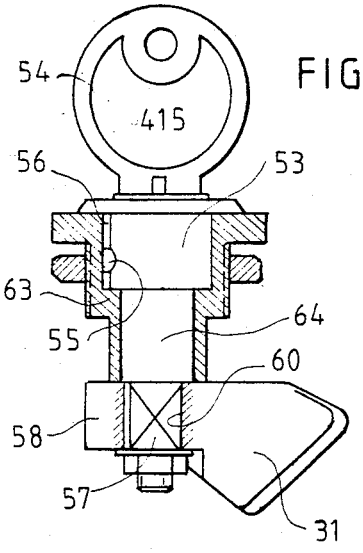
FIG. 8 is a longitudinal cross-sectional view of a lock assembly which can be opened with a key.

Whenever there is used, instead of sleeve 25, a lock barrel 64 requiring insertion of a key 54 into accessible portion 53 of the barrel so that opening and closing operations can only be effected by authorized personnel (see FIG. 8), bolt 31 must be able to rotate in the opening direction, either independently from the lock barrel upon a self-locking operation through application of pressure onto the cover, or along with the barrel whenever the operation is effected with the key.

Such an independence is required due to the fact that, once the key has been removed from sleeve 53, sleeve 53 can no longer move with respect to body 63 (see FIG. 8), e.g. because of cooperation of one or more retractable bolts 55 with an inner notch or groove 56 of the bearing of body 63; thus, any closing movement of the door through pressure onto the wall and a corresponding rotation $\alpha$ of the bolt can take place only if a coupling means giving to the bolt some angular clearance $\phi$ in direction $\alpha$ is disposed between end 57 of barrel 53 and eye 58 of the bolt.

Figure 9:
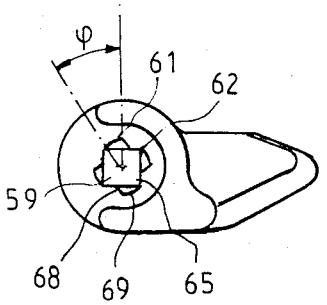
FIG. 9 shows a bottom view of the bolt of the lock assembly of FIG. 8.

Such a coupling means is illustrated as an example in FIG. 9, where end 57 of the barrel is provided with a rod 59 of prismatic shape with a square cross-sectional shape, and eye 58 is provided with an opening 60 having four splines such as 61 in which the four edges or ribs 62 of rod 59 can move through about 45°. Surfaces 69 of said splines consist of cylindrical sections of a cylinder having a diameter equal to the length of the diagonal of the cross-sectional square of rod 59. In the inoperative position, rod 59 abuts against shoulders 65, whereas in the operative position the rod rotation is limited by shoulders 68. Of course, any other menas by which an angular clearance of movement $\phi$ can be achieved may be substituted for the above means. Thus, a projection or boss moving in a groove between two positions defined by two stops or abutments, as shown at 66 in FIG. 11, could be provided.

Figure 11:
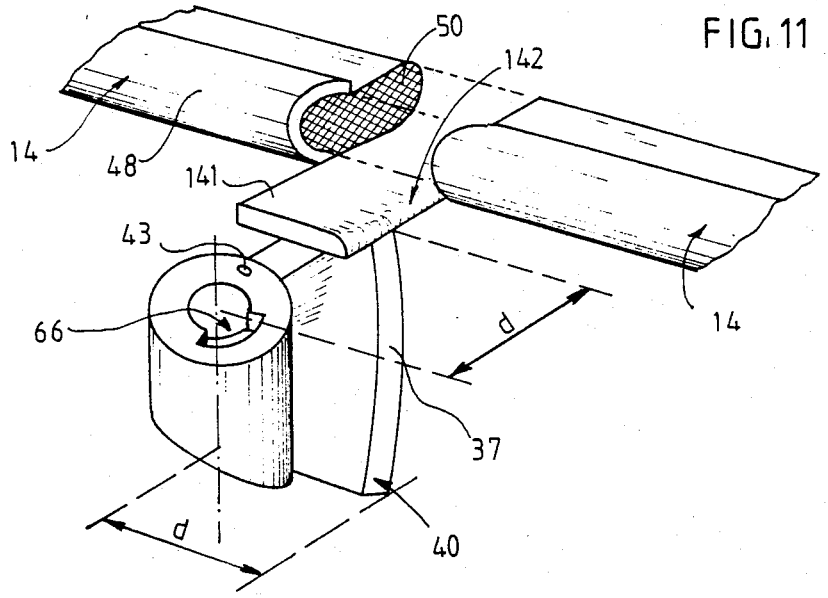
FIG. 11 illustrates a third embodiment of the lock assembly.

FIG. 11 illustrates a modified embodiment in which helical ramp 37 has the same size d at its top and at its bottom and cooperates with a tongue 141 projecting from flange 14. The tongue is made by not turning inwardly a portion of the frame.

In a further modified embodiment, seal 50 may be continuous, as shown in dotted line in FIG. 11. Tongue 141 is provided with a rounded edge 142 on the operative side thereof. Such a rounded edge is made by punching the metal plate so as to cold draw it for causing the metal surface to cooperate with the ramp upon closing and prevent ramp wear.

Figure 12:
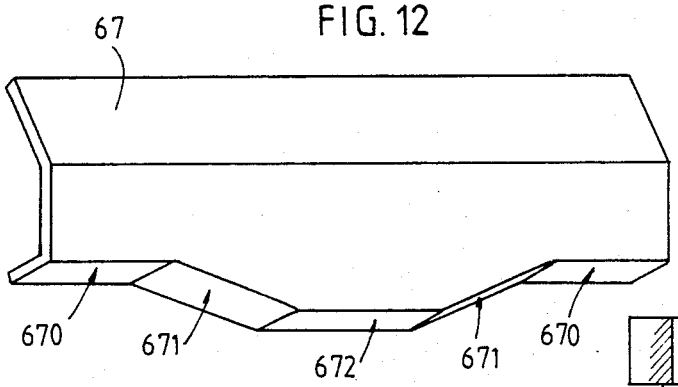
FIG. 12 is a perspective view of a member to be welded onto the inner flange of the frame.
Figure 13:
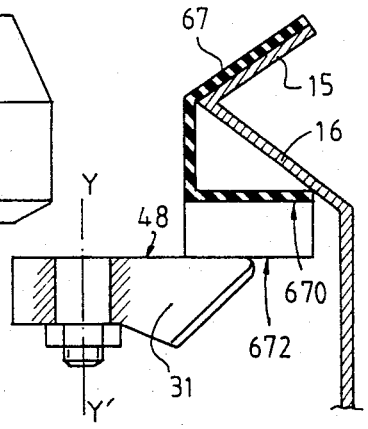
FIG. 13 illustrates a fourth embodiment of the lock assembly using the member of FIG. 12.
Figure 13:
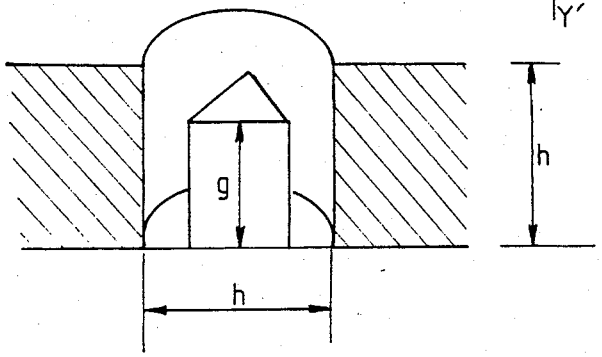

FIGS. 12 and 13 illustrate an improvement to the closure device of FIG. 7, wherein a bolt 31, the second ramp of which consists of a planar surface 48 orthogonal to axis YY', is used.

Onto first inclined portion 15 of the frame there is welded a member 67 shown in FIG. 12 and including between two planar portions 670 a pair of ramp 671 reaching to a platen 672.

When using member 67 with bolt 31 of FIG. 13, surface 48 will prohibit the cabinet to be opened back by engaging itself under one of planar portions 670, even if the force exerted onto the door does not suffice to close the cabinet completely. If the force applied to the door is sufficient to compress the seal, surface 48 will slide along ramp 671 and engage under platen 672.

It should be understood that any modification which can be made by men skilled in the art is also included in the scope of the invention.

We claim:

1. In combination:

i- a wall having an opening delimited by a frame, said frame having outer and inner surface portions joining along a protruding rim and a door having outer and inner faces and being mounted for displacement along a predetermined path for closing the said opening through co-operation with said frame, the portion of said path which is in proximity of the opening being substantially at right angles with the plane of said opening, said door having an aperature;

ii- a hollow lock body mounted in the said aperture and an elongate operating member mounted within the said lock body for angular displacement about an axis substantially at right angles with the plane of the door, said operating member having inner and outer ends and operating means projecting from the outer face of the door at the outer end of said operating member;

iii- a bolt mounted for angular displacement about the said axis at the inner end of said operating member, said bolt having outer and inner projecting surface portions joining along a protruding rim;

iv- a torsion spring connecting the lock body to the bolt and normally biasing said bolt into a first angular position;

v- the innner surface portions of said frame and of said bolt being more remote from the door inner face than the outer surface portions of said frame and of said bolt respectively; the protruding rim of the frame being located nearer from the said axis than the protruding rim of the bolt when the door is displaced along the said portion of the path; the inner projecting surface portion of the bolt being shaped for cooperation with the outer surface portion and with the protruding rim of the frame which effects a camming action for angularly displacing the bolt against the action of the torsion spring until the rim of the bolt is located nearer from the axis than the rim of the frame; and the outer projecting surface portion of the bolt being shaped for locking engagement with the inner surface portion of the frame.

2. The combination of claim 1 wherein the inner and outer surface portions of said frame are inclined in opposite directions with respect to said axis and the inner and outer surface portions of said lock are helicoidal ramps inclined in opposite directions with respect to said axis.

3. The combination of claim 1 wherein the inner surface portion of said frame and the outer surface portion of said bolt are substantially at right angles with the said axis.

4. The combination of claim 1 wherein the said operating means has a groove adapted to accomodate the tip of a screw driver or a coin.

5. The combination of claim 1, wherein the said operating means comprise a barrel adapted for cooperation with a key which simultaneously effects an angular displacement of the barrel and of the bolt when the key is inserted in the barrel, the barrel having means for preventing angular displacement thereof when the key is removed and means for coupling the bolt to the barrel, said coupling means allowing a predetermined angular motion of the bolt with respect to the barrel when the angular displacement of the barrel is prevented.

* * * * *